United States Patent [19]

Kaufmann et al.

[11] 4,298,032

[45] Nov. 3, 1981

[54] SHUTTLE GRIP

[75] Inventors: Frank H. Kaufmann; Charles F. Kramer, both of Greenville, S.C.

[73] Assignee: Steel Heddle Manufacturing Co., Greenville, S.C.

[21] Appl. No.: 940,374

[22] Filed: Sep. 7, 1978

[51] Int. Cl.[3] ..... D03J 5/16

[52] U.S. Cl. ..... 139/207

[58] Field of Search ..... 139/207

[56] References Cited

U.S. PATENT DOCUMENTS

| | | | |
|---|---|---|---|
| 3,048,197 | 8/1962 | Fink | 139/207 |
| 3,233,635 | 2/1966 | Klocker et al. | 139/207 |
| 4,003,410 | 1/1977 | Thibault | 139/207 |

FOREIGN PATENT DOCUMENTS

| | | | |
|---|---|---|---|
| 381177 | 10/1964 | Switzerland | 139/207 |
| 402768 | 3/1966 | Switzerland | 139/207 |

*Primary Examiner*—Henry Jaudon

*Attorney, Agent, or Firm*—Bailey, Dority & Flint

[57] ABSTRACT

An encapsulated shuttle grip for use in shuttles for holding bobbins in a properly aligned position during weaving. The grip includes a pair of opposed leaves which have opposed gripping jaws for receiving a butt end of a bobbin. Inner shank portions of the leaves are imbedded in a molded housing with the gripping jaws extending outwardly from the housing. The molded housing extends around the remote sides of the inner shank portions and in the space provided between the shank portions positively positioning the gripping jaws for receiving the butt end of the bobbin.

4 Claims, 4 Drawing Figures

SHUTTLE GRIP

BACKGROUND OF THE INVENTION

Presently, shuttle grips are formed in a two step U-shape such as illustrated in U.S. Pat. Nos. 2,270,821 and 2,154,050 with the larger step at the open end. They are provided with a bolt hole in the shank end and can be made plain or with ribs. A series of grooves are provided at the open end of the inside face of each leaf for supporting a bobbin by the rings carried on a butt end thereof during weaving.

The manufacture of these grips requires many operations including heat treatment which work against precise dimensional accuracy required in the completed shuttle assembly. Therefore, it has always been necessary to reform a large number of grips after insertion into the shuttle in order to achieve the desired bobbin alignment. Also, necessary operations such as tumbling to remove burrs and shot peening to increase fatigue life are less effective on the inside faces of the "U" shape.

Rubber pads have been utilized with the steel shuttle grips in order to dampen vibrations incurred during use. Examples of these dampened shuttle grips are shown in U.S. Pat. Nos. 2,270,821, 3,048,197, 3,351,100, and 2,154,054.

In U.S. Pat. No. 3,048,197, there is disclosed a bobbin clamping device which includes clamping jaws that can be moved parallel to each other when the bobbin is being changed and also claims to permit the bobbin to be perfectly centered during operation.

SUMMARY OF THE INVENTION

In accordance with the present invention, an encapsulated shuttle grip is provided for use in a shuttle for holding a bobbin in a properly aligned position during weaving. The shuttle grip includes a pair of opposed leaves having outer spaced apart gripping jaws for receiving the butt end of the bobbin and inner shank portions. A housing is molded around and in between the inner shank portions for firmly and positively holding the outer ends of the leaves which includes gripping jaws at a predetermined and proper spacing. The housing has an inclined surface extending down between the gripping jaws which acts as a guiding surface for guiding bobbins between the gripping jaws when being inserted therein.

Accordingly, it is an important object of the present invention to encase a shuttle grip within a housing precisely positioning the gripping jaws of the leaves relative to each other.

Another important object of the present invention is to provide a shuttle grip which, when inserted in a shuttle, absorbs shocks and minimizes metal fatigue failures that are normally inherent in transfer of bobbins.

Still another important object of the present invention is to provide a shuttle grip wherein the hardness of the leaves can be greater than the normal hardness of conventional leaves as a result of minimizing deflection stresses normally caused by insertion and transfer.

These and other objects and advantages of the invention will become apparent upon reference to the following specification, attendant claims, and drawing.

DESCRIPTION OF THE PREFERRED EMBODIMENT

Figure 1:
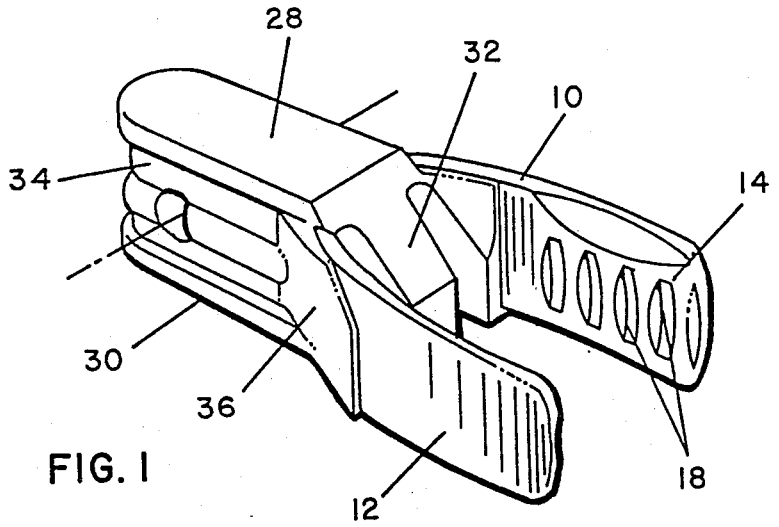
FIG. 1 is a perspective view illustrating an encapsulated shuttle grip constructed in accordance with the present invention.

Referring in more detail to the drawing, there is illustrated a pair of leaves 10 and 12 which are constructed of conventional steel utilized for shuttle grips which have gripping jaws 14 and 16 on the inner surfaces of the outer ends. Grooves 18 are provided on the inner surfaces of the gripping jaws 14 and 16 for receiving the rings normally provided on the butt end of a bobbin. The leaves 10 and 12 taper inwardly as illustrated in the intermediate portions 20 and 22 and terminate in shank end portions 24 and 26.

The shank end portions are encased in a molded housing that has substantially flat top and bottom surfaces 28 and 30 provided thereon. The housing is molded of any suitable material such as rubber, urethane, or plastic which firmly holds the shank end portion therein. One suitable material used is 95 D durometer polyurethane.

Figure 2:
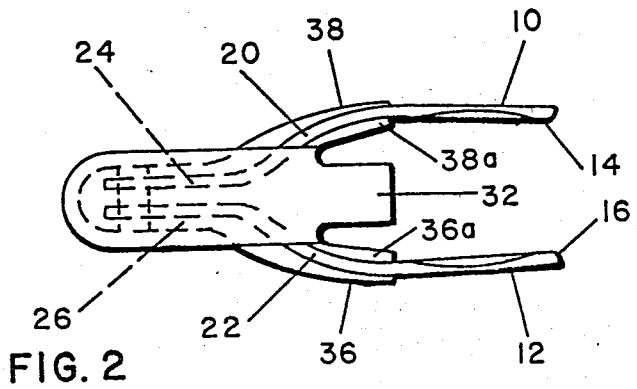
FIG. 2 is a plan view of the grip illustrated in FIG. 1.
Figure 4:
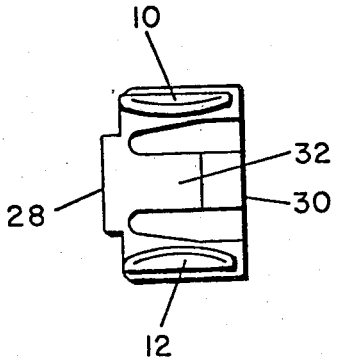
FIG. 4 is an elevational view looking from the right hand side of the grip as illustrated in FIG. 2.
Figure 3:
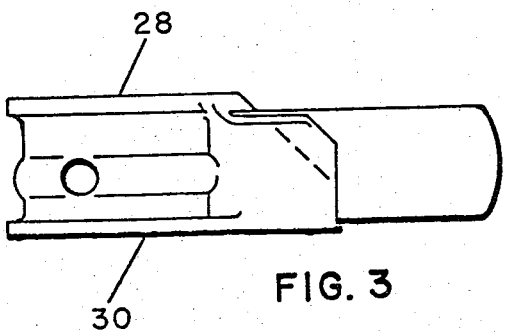
FIG. 3 is a side elevational view of the shuttle grip constructed in accordance with the present invention.

As can be seen in FIG. 2, the housing extends on both sides of the shank portions 24 and 26 of the leaves and extends down in between the inner surfaces of the shank portions.

Adjacent the forward end of the housing is an inclined surface 32 which acts as a guiding surface for the butt end of a bobbin as it is inserted between the jaws 14 and 16. An open space is provided on opposed sides of the inclined surface 32 adjacent walls **36*a* and 38*a***.

The exterior side walls 34 of the housing recess within the top and bottom surfaces 28 and 30 and have integral forwardly projecting portions 36 and 38 which encase the intermediate portions 20 and 22 of the leaves. Also extending outwardly from the main body portion of the housing are walls **36*a* and 38*a***. As a result of the integral housing encasing the intermediate and shank portions of the leaves, the outer ends of the leaves are precisely positioned relative to each other. It is to be understood that different leaf shapes, thicknesses and types of material can be used.

As a result of the housing producing most of the ring grasping pressure, the leaves may be constructed of steel that is harder than conventional steel leaves used in bobbins. This is because in conventional shuttle springs the shuttle spring is normally constructed of a single piece of steel such as illustrated in U.S. Pat. No. 2,154,050 which causes additional stresses to be imparted to the shank portion during bobbin insertion and transfer.

Furthermore, shuttle splitting is minimized with the shuttle grip constructed in accordance with the present invention because the rubberlike housing can be more perfectly shaped to conform to the handle cut provided in the shuttle.

Other means for securing the shank end portions of the leaves in a spaced relation could be utilized in lieu of the molded housing. A spacer is positioned between the shank end portions and rivets extend between the shank ends and through the spacer. The rivets and spacer securely hold the shank portions.

While a preferred embodiment of the invention has been described using specific terms, such description is for illustrative purposes only, and it is to be understood that changes and variations may be made without departing from the spirit or scope of the following claims.

What is claimed is:

1. An encapsulated shuttle grip for use in a shuttle for holding a bobbin in a properly aligned position during weaving, positioning rings carried on a butt end of said bobbin, said shuttle grip comprising:

a pair of opposed rigid steel leaves having:

(i) outer spaced apart steel gripping jaws for receiving a butt end of a bobbin, (ii) inner shank portions, and (iii) grooves provided on inner surfaces of said steel gripping jaws for receiving said rings of said bobbin, a molded housing, said inner shank portions being imbedded in said molded housing with said gripping jaw portions extending outwardly from said housing in a spaced apart relationship for receiving a bobbin head, said inner surfaces of said steel gripping jaws being free of said molded housing, and said molded housing extending on both sides of each leaf a sufficient distance toward said outer spaced apart steel jaws for positively and firmly holding said outer ends of said leaves in precise spaced apart relation maintaining the alignment of said leaves relative to each other as preset during molding said housing on said leaves.

2. The encapsulated shuttle grip as set forth in claim 1 further comprising;

said leaves being two separate members, and said housing including an integral portion extending on remote sides of said inner shank portions of said leaves, and in a space provided between said inner shank portions firmly holding said leaves.

3. The encapsulated shuttle grip as set forth in claim 2 further comprising:

a downwardly sloped member carried between said gripping jaws and being integrally connected to said portion of said housing provided between said inner shank portions.

4. An encapsulating shuttle grip for use in a shuttle for holding a bobbin by a butt end in a properly aligned position during weaving, said shuttle grip comprising:

a pair of opposed leaves each having:

(i) an outer gripping jaw portion for receiving a butt end of a bobbin, (ii) an inner shank portion, (iii) an arcuate intermediate portion joining said outer gripping jaw with said inner shank portion, a molded housing, said inner shank portions and said arcuate intermediate portions being embedded in said molded housing with said gripping jaw portions extending outwardly from said housing in a precise spaced apart relationship for receiving a bobbin head and firmly holding said butt end therebetween, inner surfaces of said steel gripping jaws being exposed for receiving said bobbin head, and said precise spaced apart relationship of said gripping jaw portion being preset during molding said housing around said leaves.

* * * * *